US006725562B2

(12) United States Patent
Nakagawa et al.

(10) Patent No.: US 6,725,562 B2
(45) Date of Patent: Apr. 27, 2004

(54) HAIRDRYER

(75) Inventors: Takashi Nakagawa, Hikone (JP); Takahiro Kumode, Hikone (JP)

(73) Assignee: Matsushita Electric Works, Ltd. (JP)

( * ) Notice: Subject to any disclaimer, the term of this patent is extended or adjusted under 35 U.S.C. 154(b) by 0 days.

(21) Appl. No.: 10/170,794

(22) Filed: Jun. 12, 2002

(65) Prior Publication Data

US 2002/0189128 A1 Dec. 19, 2002

(30) Foreign Application Priority Data

Jun. 14, 2001 (JP) ..... 2001-180809

(51) Int. Cl.[7] ..... A45D 1/00
(52) U.S. Cl. ..... 34/96; 34/98; 392/380
(58) Field of Search ..... 34/96, 97, 98, 34/95; 392/379, 380

(56) References Cited

U.S. PATENT DOCUMENTS

| | | | | | |
|---|---|---|---|---|---|
| 3,674,980 | A | * | 7/1972 | Cox | 219/367 |
| 3,892,247 | A | | 7/1975 | Andersen | 132/11 R |
| D251,857 | S | * | 5/1979 | Harigai | D28/13 |
| 4,197,448 | A | * | 4/1980 | Harigai | 219/370 |
| 4,333,123 | A | * | 6/1982 | Moulden | 361/213 |
| 5,546,674 | A | * | 8/1996 | Lange et al. | 34/97 |
| 5,911,226 | A | * | 6/1999 | Vecchiola et al. | 132/211 |
| 5,975,090 | A | * | 11/1999 | Taylor et al. | 132/116 |
| 6,067,724 | A | * | 5/2000 | Depoyian | 34/97 |
| 6,182,671 | B1 | * | 2/2001 | Taylor et al. | 132/116 |
| 6,191,930 | B1 | | 2/2001 | Ramchandani | 361/213 |
| 6,393,718 | B1 | * | 5/2002 | Harris et al. | 34/96 |
| 2003/0033726 | A1 | * | 2/2003 | Saida | 34/96 |

FOREIGN PATENT DOCUMENTS

| | | | |
|---|---|---|---|
| JP | 6-315414 | 11/1994 | A46B/15/00 |
| JP | 6-315424 | 11/1994 | |
| JP | 8-47415 | 2/1996 | A45D/20/12 |
| JP | 8-047415 | 2/1996 | |
| JP | 9-350 | 1/1997 | A46B/15/00 |
| JP | 9-000350 | 1/1997 | |

* cited by examiner

*Primary Examiner*—Henry Bennett
*Assistant Examiner*—Camtu Nguyen
(74) *Attorney, Agent, or Firm*—Osha Novak & May L.L.P.

(57) ABSTRACT

The hair dryer includes a housing body that includes an air intake opening and an air outlet opening. The air outlet opening includes a non-ionized air outlet opening and an ionized air outlet opening. A fan is disposed within the housing body for introducing air into the housing body through the air intake opening and directing the air to the air outlet opening. An ionized air passage mechanism is formed within the housing body and is connected to the ionized air outlet opening. An air ionizing device is disposed within the ionized air passage mechanism for generating ionized air. Under this configuration, ionized air generated by the air ionizing device is discharged from the ionized air outlet opening and non-ionized air is discharged through the non-ionized air outlet opening such that both ionized air and non-ionized air are blown together from the air outlet openings of the hairdryer against hair.

15 Claims, 6 Drawing Sheets

HAIRDRYER

BACKGROUND OF INVENTION

A hairdryer equipped with a negatively ionized air generator has been used as a hairdryer having the capability of not only expelling heated air for drying and setting hair but also carrying out hair treatment.

FIG. 6 is a schematic drawing of a conventional hairdryer of the above kind. An air passage (102) is formed in the interior of an attachment portion (300) of this hairdryer. The attachment portion (300) is attached to a substantially cylindrical main body portion (100). An air passage (111) is formed in the interior of the main body portion (100). An inlet opening (not shown) is formed through the main body portion (100) for intake of outside air. A plurality of air outlet openings (104) are formed through the attachment portion (300).

A fan (112), a motor (113), a heater, and an air ionizing device (106) for generation of negatively ionized air are disposed within the air passage (111) of the main body portion (100). The main body portion (100) itself forms a handle. A power supply switch is disposed at the exterior surface of the main body portion (100).

When the power switch of this hairdryer is operated, electric current flows to the motor (113), the heater, and the air ionizing device (106). Air taken in from the intake opening is blown by the fan (112) toward the attachment portion (300) through the air passage (111). Air which is taken in through the intake opening is heated by the heater. Then negatively ionized air generated by the air ionizing device (106) is intermixed with this heated air, and the resultant intermixed air containing negatively ionized air passes through the air passage (102) of the attachment portion (300) and is expelled from air outlet openings (104). Thus in addition to drying and setting of the hair, a negative ion treatment effect can also be imparted to the hair since heated air containing air which has been negatively charged in this manner is blown against the hair.

However, negative ions generated by the air ionizing device (106) within the main body portion (100) impart a negative charge in the passage up until expulsion from the air outlet openings (104) (i.e., walls of the air passage (111) of the main body portion (100) and the air passage (102) of the attachment portion (300), and components disposed within this passage) by attachment to wall surfaces, etc. or by attachment in the vicinity of the multiple air outlet openings formed in the attachment portion (300). Thus, this conventional hairdryer is deficient in that negative ions undergo an electrical repulsive force that makes it difficult for the negative ions to arrive at the air outlet openings (104). This greatly decreases the number of negative ions output from the air outlet openings (104).

SUMMARY OF INVENTION

In general, in one aspect, the present invention relates to a hairdryer that comprises a housing body which includes an air intake opening and an air outlet opening. The air outlet opening comprises a non-ionized air outlet opening and an ionized air outlet opening. The hairdryer includes a fan disposed within the housing body for introducing air into the housing body through the air intake opening and directing the air to the air outlet opening. An ionized air passage mechanism is formed within the housing body and is connected to the ionized air outlet opening. An air ionizing device is disposed within the ionized air passage mechanism for generating ionized air. The ionized air generated by the ionizing device is discharged from the ionized air opening and non-ionized air is discharged from the non-ionized air outlet opening such that both ionized air and non-ionized air are blown together from the air outlet opening of the hairdryer.

In general, in one aspect, the present invention also relates to a method for drying and treating hair. The method includes introducing air into a hairdryer, directing the air introduced into the hairdryer toward an ionized air passage mechanism formed in the hairdryer wherein an air ionizing device is disposed. The method further includes ionizing the air introduced into the ionized air passage mechanism by the air ionizing device, and expelling the air ionized by the air ionizing device through an ionized air opening of the hairdryer. The method further includes expelling the air not introduced into the ionized air passage mechanism through a non-ionized air opening of the hairdryer such that ionized air and non-ionized air are blown together to hair simultaneously.

BRIEF DESCRIPTION OF DRAWINGS

FIG. 3(*b*) is a cross-sectional view across A—A of FIG. 3(*a*).

FIG. 4(*b*) is a magnified view of part of FIG. 3(*b*).

DETAILED DESCRIPTION

Figure 1:
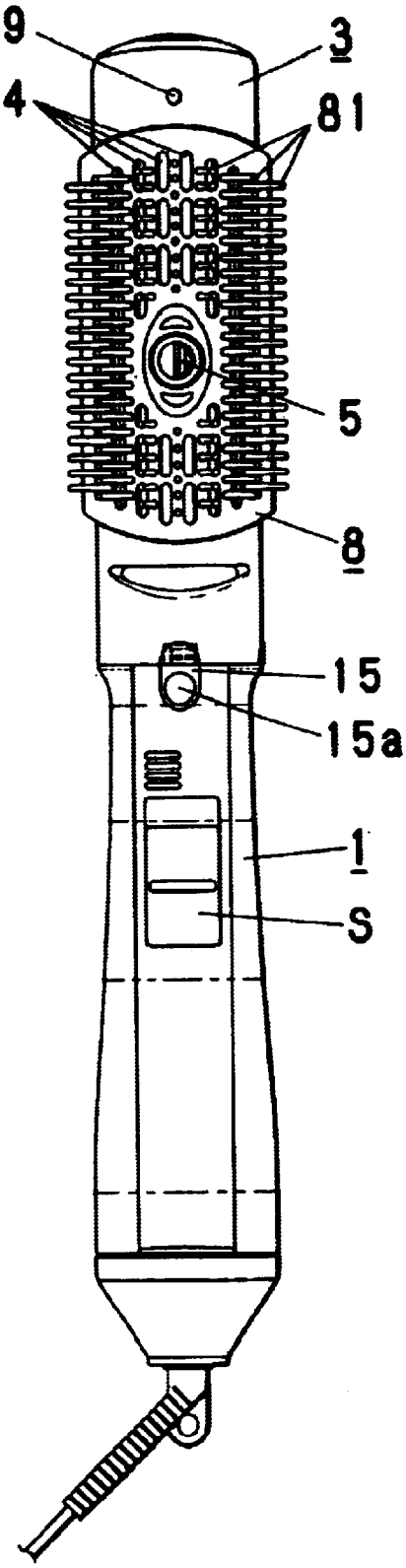
FIG. 1 is a front view of a hairdryer in accordance with an embodiment of the present invention.

Referring now to the drawings wherein like reference characters are used for like parts throughout the several views, an embodiment of the present invention is explained in detail as follows.

Figure 2:
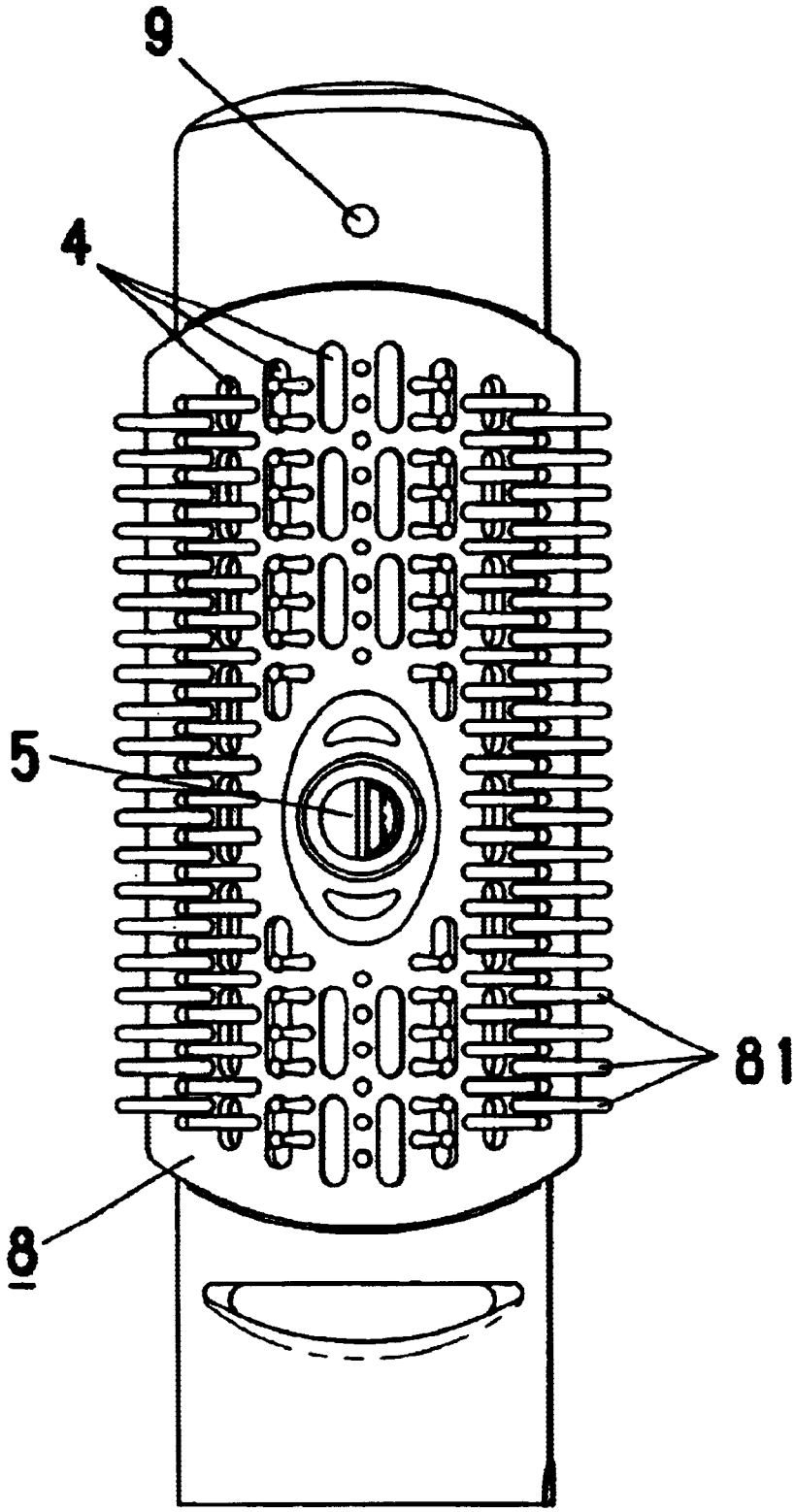
FIG. 2 is a magnified view of part of FIG. 1.
Figure 3:
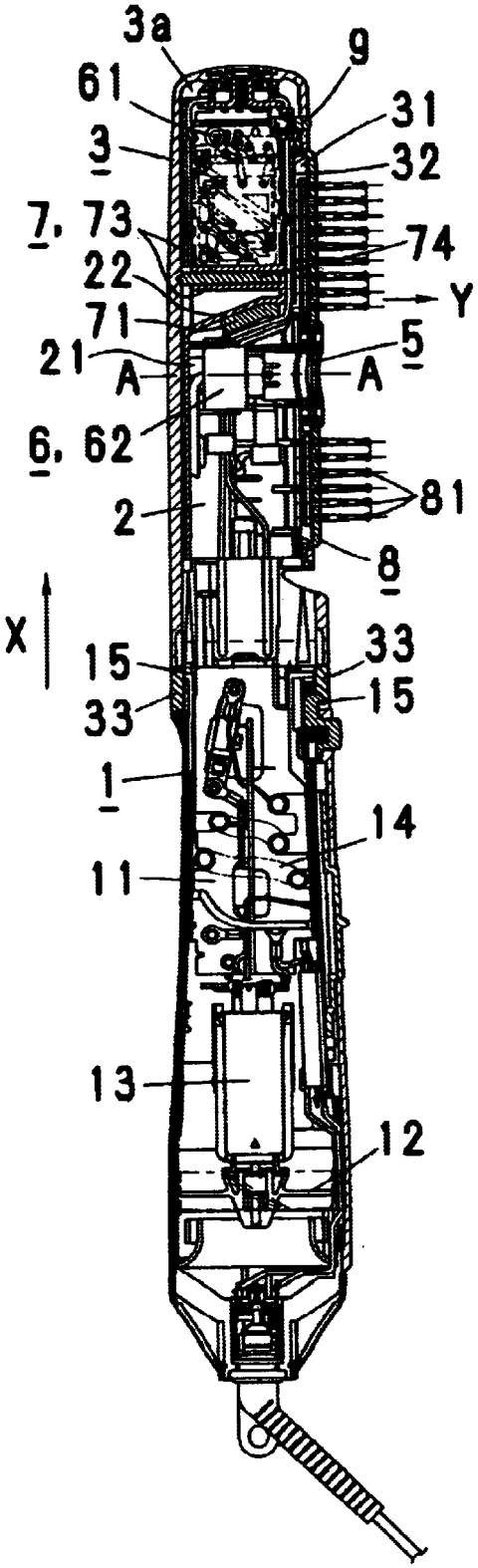
FIG. 3(*a*) is a longitudinal cross-sectional view of a hairdryer in accordance with an embodiment of the present invention.
Figure 3:
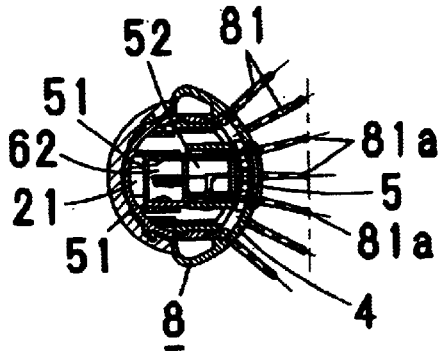
Figure 4:
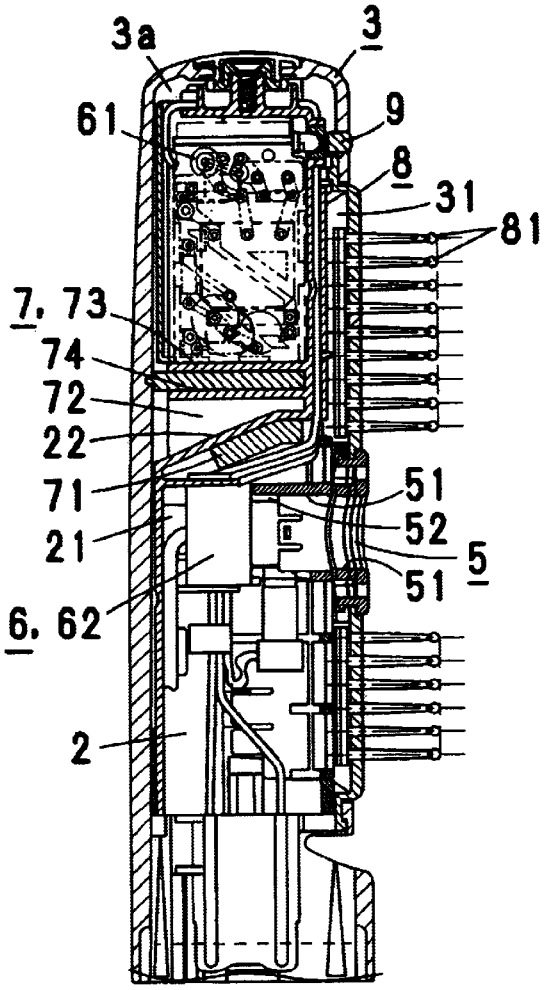
FIG. 4(*a*) is a magnified view of part of FIG. 3(*a*).
Figure 4:
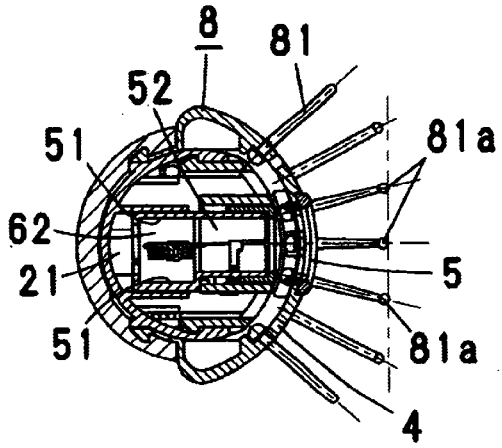

FIG. 1 is a frontal view of a hairdryer according to an embodiment of the present invention. FIG. 2 is a magnified view of part of FIG. 1. FIG. 3(*a*) is a longitudinal cross-sectional drawing of a hairdryer according to an embodiment of the present invention. FIG. 4(*a*) is a magnified view of part of FIG. 3 (*a*). As shown in FIG. 1 and FIG. 3(*a*), a hairdryer in accordance with the present invention comprises a main body portion (1) and an attachment portion (3). Within the figures, the upper part of the figure is referred to as the down-flow end, and the bottom part of the figure is referred to as the up-flow end, of the flow of air sent from the main body portion (1) to the attachment portion (3).

As shown in FIG. 3(*a*), an air passage (11) is formed within the substantially cylinder-shaped main body portion (1), an intake opening (not shown) is formed at the extreme up-flow end thereof for intake of air. An opening (not shown) is formed connecting to an air passage (2) of the attachment portion (3) at the down-flow end of the main body portion (1) as described below. In order from the up-flow side, a fan (12), a motor (13), and a heater (14) are disposed in the air passage (11) within the main body portion (1). Operation of the motor (13) causes rotation of the fan (12), takes air in from the intake opening, and sends this air toward the down-flow direction. A mounting part (15) is formed at the down-flow end of the main body portion (1) for freely attaching and removing the attachment portion (3).

The air passage (2) is formed within the attachment portion (3) which has a substantially cylindrical shape. The attachment portion (3) is connected to the main body portion (1) by a cover attachment portion (33) which is disposed at the up-flow end of the attachment portion (3). An opening (not shown) is formed in the up-flow end of the attachment portion (3). This opening connects together the air passage (2) of the attachment portion (3) and the air passage (11) of the main body portion (1). As shown in FIG. 3(*a*) and FIG. 4(*a*), an inclined wall (22) tilted with respect to the lengthwise direction (i.e., central axis (x) direction within the figure) is disposed at the approximate center along the central axis (x) direction within the air passage (2) of the attachment portion (3). A cover wall (32) is disposed at the down-flow end of inclined the wall (22) and is connected thereto. The down-flow end of the cover wall (32) is connected to the attachment portion (3) proximate to an opening (31) formed therein. A brush (8) is attached to the opening (31) and covers the opening (31). A substantially cylindrical ion passage wall (51) is disposed proximate to the up-flow end of the inclined wall (22) at a location facing a below-described ion outlet opening (5) so as to form an ion passage (52). As described below, an ion generator (62) is contained within the ion passage (52).

As indicated by FIG. 4(*a*), the brush (8) is formed extending in the central axis direction (x direction) and has approximately the same shape and size as the opening (31). The brush (8) is attached to the attachment portion (3) so as to cover the opening (31). The brush (8) may be formed from a material such as silicone rubber, etc. which has a low electrostatic propensity. As shown in FIG. 1 and magnified in partial view FIG. 2 of FIG. 1, air outlet openings (4) for expelling of heated air to the exterior of the attachment portion (3) and an ion outlet 5 are formed through the brush (8). As shown in FIG. 2, the air outlet openings (4) may be disposed in multiple rows aligned along the central axis (x) direction (6 rows in the present embodiment), and each of the plurality of the air outlet openings (4) may have a substantially elliptical shape whose major axis extends in the central axis (x) direction. At the approximate center of the surface through which the air outlet opening (4) of the brush (8) is formed, the ion outlet opening (5) is formed for expelling negatively ionized air.

As shown particularly clearly in FIG. 2, multiple rows of bristles (81) are formed extending along the central axis (x) direction on the surface in which the air outlet openings (4) of the brush (8) are formed. In the present embodiment, a total of 7 rows of the bristles (81) are formed aligned along the central axis (x) direction of the brush (8) between the previously mentioned 6 rows of the air outlet openings (4) and are formed on the surface in which the air outlet openings (4) of the brush (8) is formed. As shown in FIG. 4(*a*), the top ends (81*a*) of the central 3 rows of the bristles (81) may be disposed within substantially the same plane. That is to say, the top ends (81) of these central 3 rows may be positioned on a plane P which is perpendicular to the flow direction ((y) direction) of air expelled from the air outlet opening (4) and the flow direction of below-described negatively ionized air. By such placement, since the hairdryer is oriented such that this plane P is perpendicular with respect to the direction of blowing of air and negatively ionized air, the direction of expelled air (y direction) can readily be made to coincide with the intended direction of blown air during use of the hairdryer.

As shown in FIG. 4(*a*), an ionizing device (6) for generation of negatively ionized air is disposed within the attachment portion (3). The ionizing device (6) includes an ionizing circuit (61) used for ion generation by generation of electricity for negative ionization of air and the ion generator (62) for generation of negatively ionized air.

The ionizing circuit (61) is disposed in a space surrounded by the inclined wall (22), the cover wall (32), and a wall surface of the attachment portion (3) (i.e., at an end part (3*a*) as shown in FIG. 3(*a*). In this embodiment, an insulation part (7) is provided between the air passage (2) and the ionizing circuit (61). In this embodiment, there is provided a insulation material (71) at the air passage (2) side. Also, there is provided an air layer (72) at the backside of the inclined wall (22) (i.e., the end part (3*a*) side), thus forming a double wall (73) which contains a packing (74). This structure prevents an adverse effect upon the ionizing circuit (61) due to conduction or transmission to the ionizing circuit (61) heated air flowing through the air passage (2). At the outside wall surface of the attachment portion (3) equipped with the ionizing circuit (61), an indicator (9) is preferably provided for indicating generation of negatively ionized air. The indicator (9) (e.g., an LED, etc.) is disposed on the attachment portion (3). The indicator (9) is connected to the ionizing circuit (61) and indicates generation or lack of generation of negatively ionized air. Thus the user is able to readily confirm whether or not negatively ionized air is generated.

As shown in FIG. 4(*a*), the ion generator (62) is disposed at the innermost side of the attachment portion (3) opposite the ion outlet opening (5) of an ion passage (52). The ionizing circuit (61) is connected electrically by an electrical cord, etc. to the ion generator (62). As made clear by FIG. 3(*b*) and magnified partial view FIG. 4(*b*) of FIG. 3, an air feed space (21) is formed between the ion generator (62) and the inner wall surface of the attachment portion (3). The ionizing device (6) is constructed so that air is able to pass therethrough. Heated air flowing into the air feed space (21) from the air passage (2) of the attachment portion (3) passes through the ionizing device (6) and is expelled to the outside from the ion outlet opening (5).

Since high voltage generated by the ionizing circuit (61) is applied to opposing discharge electrodes, the ion generator (62) of the present embodiment generates a corona discharge and produces negatively ionized air. This negatively ionized air generated by the ion generator (62) is expelled to the outside from the ion outlet opening (5) and entrained together with heated air fed into the air feed space (21) from the air passage (2) of the attachment portion (3). Of course, the ionization method is not limited to the use of such corona discharge. Use of another method for negative ionization of air is possible in order to produce more negative ionization of air.

Figure 5:
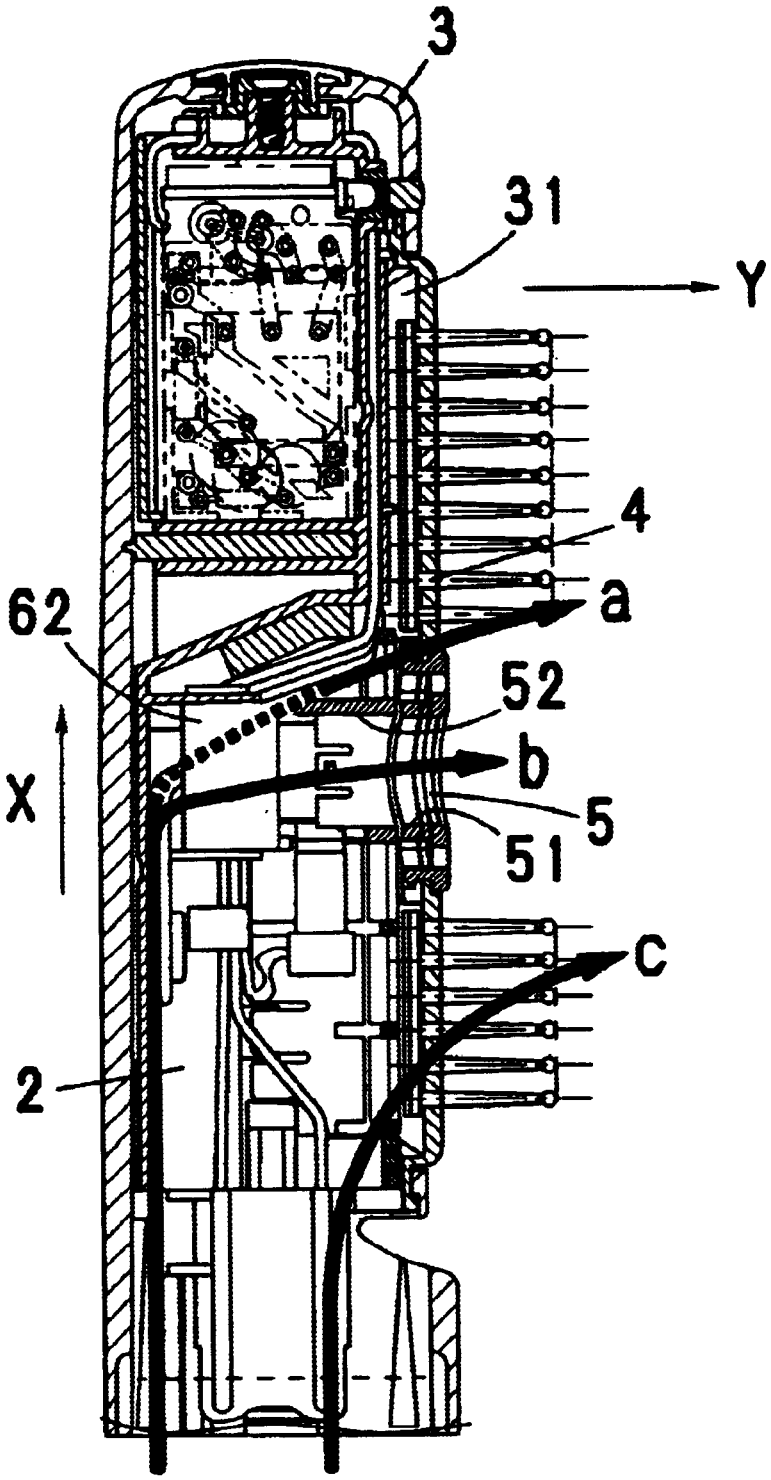
FIG. 5 is a longitudinal cross-sectional view showing flow of the air within the attachment portion for one embodiment of the invention.
Figure 6:
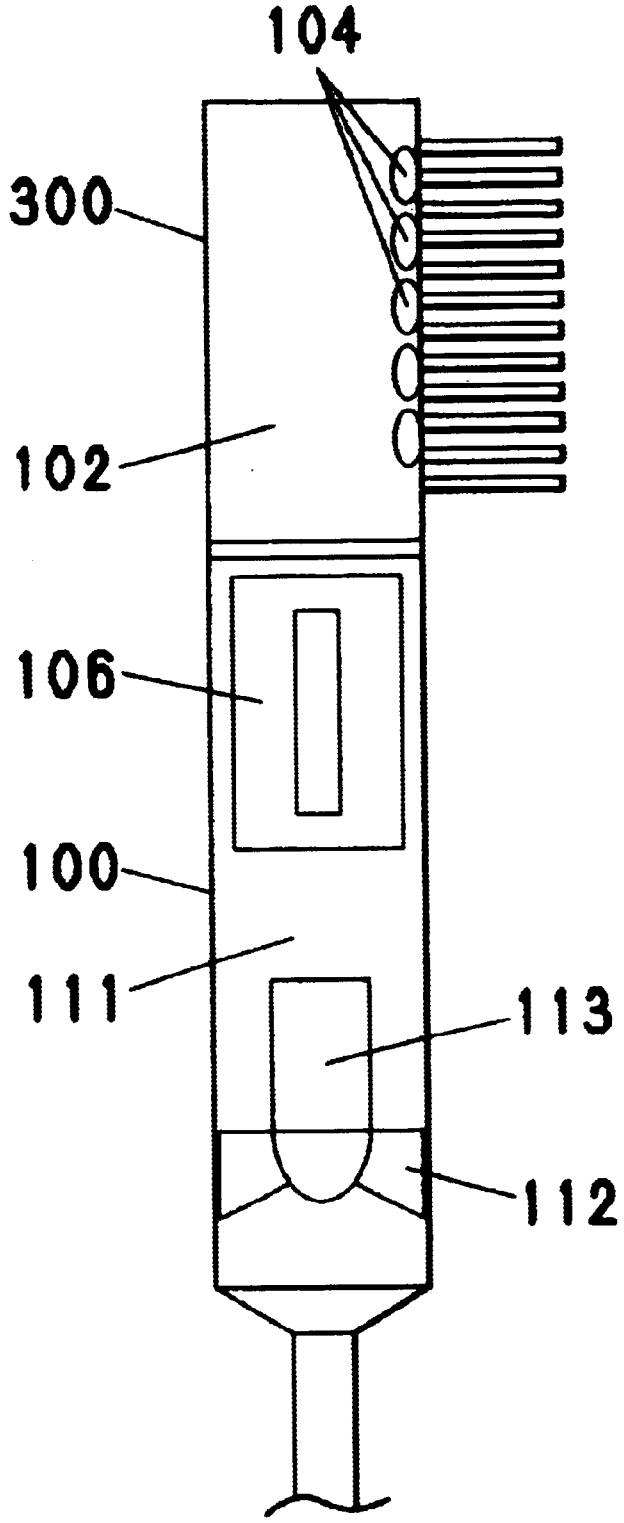
FIG. 6 (PRIOR ART)
FIG. 6 is a schematic drawing showing a conventional hairdryer.

Air fed into the attachment portion (3) from the main body portion (1) is expelled to the outside through the air outlet openings (4) or the ion outlet opening (5) as shown in FIG. 5. As indicated by arrow a in FIG. 5, air flowing in the central axis (x) direction through the air passage (2) of the attachment portion (3) collides with the inclined wall (22) so that direction of flow changes to a direction ((y) direction in the figure) substantially perpendicular to the central axis (x) direction. After redirection in the (y) direction, this air flows into opening (31) which is formed elongated in the central axis (x) direction along the wall surface of the air outlet opening (4) of the attachment portion (3). Thereafter the air is expelled to the outside from the air outlet openings (4) formed at the up-flow side of the opening (31). As indicated by arrows a and c, air fed into the attachment portion (3) from the main body portion (1) collides with the up-flow side of the outside wall of the ion passage wall (51) and is redirected in the same manner toward the (y) direction. Thereafter this redirected air is expelled to the outside from the air outlet openings (4) which surround the ion outlet opening (5). As indicated by arrow b, air flowing through the air feed space (21) of the attachment portion (3) and fed into the ion passage (52) (which is surrounded by the substantially cylindrically-shaped ion passage wall (51)) thereafter passes through the ion generator (62) (which produces negatively ionized air) and is expelled to the outside from the ion outlet opening (5). Since the air outlet openings (4) and the ion outlet opening (5) are formed separately in this manner, air flowing through the air passage (2) which is redirected in the (y) direction and negatively ionized air, are expelled in the (y) direction respectively from the outlet openings (4) and the ion outlet opening (5). In this manner, heated air containing negatively ionized air is blown against the hair and does not just dry and set the hair. This heated air containing negatively ionized air also has the effect of imparting treatment to the hair by negatively ionized air.

According to the above mentioned structure, the air passage (2) of the attachment portion (3) includes the air outlet openings (4) which expel air and the ion outlet opening (5) (formed in the surface in which the air outlet opening (4) is formed) which expels negatively ionized air. Thus negatively ionized air adhering to the wall surface of the air passage (2) and the perimeter wall surface of the air outlet opening (4), etc. does not impart a negative static charge, and thereafter the generated negatively ionized air does not undergo electrical repulsive force which would markedly decrease the expelled quantity of negatively ionized air. Thus it becomes possible to expel negatively ionized air steadily from the ion outlet opening (5) and to blow such negatively ionized air against the hair.

The attachment portion (3) is equipped with the ionizing device (6) which generates negatively ionized air. Thus the ion generator (62) which produces negatively ionized air for the ionizing device (6) can be disposed proximate to the ion outlet opening (5). Thus it becomes possible to more reliably prevent the decreased arrival of negatively ionized air at the ion outlet opening (5) and the decreased expelling of negatively ionized air from the ion outlet opening (5) which result from electrical repulsive force due to attachment of negatively ionized air during passage through the ion passage (52).

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A hairdryer comprising:

a housing body having an air intake opening and an air outlet opening, wherein the air outlet opening comprises an ionized air outlet opening and a plurality of non-ionized air outlet openings disposed about a periphery of the ionized air outlet opening;

a fan disposed within the housing body for introducing air into the housing body through the air intake opening and directing the air to the air outlet opening;

an ionized air passage mechanism formed within the housing body and connected to the ionized air outlet opening; and an air ionizing device disposed within the ionized air passage mechanism for generating ionized air, wherein ionized air generated by the air ionizing device is discharged from the ionized air opening and non-ionized air is discharged from the plurality of non-ionized air outlet openings.

2. The hairdryer according to claim 1, wherein the air introduced into the housing body through the air intake opening is directed to the air ionizing device to be ionized therein and discharged from the ionized air outlet opening through the ionized air passage mechanism.

3. The hairdryer according to claim 1, further comprising a heater disposed within the housing body for heating the air introduced into the housing body.

4. The hairdryer according to claim 1, wherein the housing body comprises a main body portion and an attachment portion, and the air outlet opening is formed in the attachment portion.

5. The hairdryer according to claim 4, wherein an indicator for indicating a state of generation of ionized air is disposed on the attachment portion.

6. The hairdryer according to claim 4, wherein the attachment portion comprises a brush portion having a plurality of bristles thereon for brushing the hair, and the ionized air outlet opening and the non-ionized air outlet opening are disposed in the brush portion.

7. The hairdryer according to claim 6, wherein the bristles are arranged in at least three rows on a surface of the brush portion such that top ends of the bristles are positioned to form a substantially flat plane.

8. The hairdryer according to claim 4, wherein a tapered wall is disposed at a corner of the ionized air passage mechanism such that the air sent to the attachment portion is directed to the air outlet opening.

9. The hairdryer according to claim 6, wherein the ionized air outlet opening is disposed proximal a central position of the brush portion.

10. The hairdryer according to claim 1, wherein the air ionizing device comprises a high voltage generation circuit and an ionized air generator, and the high voltage generation circuit is disposed at a separate position from the ionized air generator such that the high voltage generation circuit does not hinder air flow from the fan to the ionized air generator.

11. The hairdryer according to claim 10, wherein the high voltage generation circuit and an ionized air generator are insulated by a heat insulating member.

12. The hairdryer according to claim 10, wherein an air introduction space is formed adjacent to the ionized air generator such that the air directed to the air ionization device is first introduced into the air introduction space and thereafter sent to the ionized air generator to be ionized therein.

13. The hairdryer according to claim 6, wherein the brush portion is formed of an electrically insulating material.

14. A method for drying and treating hair, comprising:

introducing air into a hairdryer by a fan disposed within the hairdryer;

directing the air toward an ionized air passage mechanism formed in the hairdryer and having an air ionizing device disposed therein;

ionizing the air introduced into the ionized air passage mechanism by passing the air through the air ionizing device; and discharging air ionized by the air ionizing device through an ionized air opening of the hairdryer and discharging the non-ionized air through a plurality of non-ionized air openings of the hairdryer.

15. The method according to claim 14, further comprising heating the air introduced into the hairdryer by a heater disposed in the hairdryer.

* * * * *